United States Patent [19]

Borodulin et al.

[11] Patent Number: 4,911,149

[45] Date of Patent: Mar. 27, 1990

[54] VIBRATORY TREATMENT METHOD AND APPARATUS

[75] Inventors: German Borodulin; Maxim Persidsky, both of San Francisco; Alexander Shkolnik, San Mateo, all of Calif.

[73] Assignee: Urological Instruments Research, Inc., San Francisco, Calif.

[21] Appl. No.: 241,522

[22] Filed: Sep. 7, 1988

Related U.S. Application Data

[63] Continuation-in-part of Ser. No. 112,467, Oct. 10, 1986, Pat. No. 4,773,400, which is a division of Ser. No. 896,810, Aug. 15, 1986, Pat. No. 4,705,029, which is a continuation-in-part of Ser. No. 861,871, May 12, 1985, abandoned, which is a division of Ser. No. 778,760, Sep. 23, 1985, Pat. No. 4,607,626, which is a continuation-in-part of Ser. No. 621,842, Jun. 18, 1984, abandoned.

[51] Int. Cl.[4] ..... A61H 1/00

[52] U.S. Cl. ..... 128/32; 128/43; 128/421; 128/788; 606/198

[58] Field of Search ..... 128/32, 43, 341, 343, 128/783, 345, 784, 786, 788, 798, 794, 419 E, 421, 422, 423, 424, 654, 733; 604/104–109

[56] References Cited

U.S. PATENT DOCUMENTS

| | | | |
|---|---|---|---|
| 1,191,683 | 7/1916 | Finley . | |
| 3,495,586 | 2/1970 | Regenbogen . | |
| 3,626,931 | 12/1971 | Bysakh | 128/32 |
| 3,669,100 | 6/1972 | Csanad | 128/32 |
| 3,741,214 | 6/1973 | Tillander . | |
| 3,749,100 | 7/1973 | Von der Mosel | 128/788 |
| 3,792,701 | 2/1974 | Kloz et al. . | |
| 3,800,800 | 4/1974 | Garbe et al. | 128/788 |
| 3,823,717 | 7/1974 | Pohlman et al. . | |
| 3,927,675 | 12/1975 | Pohlman et al. . | |
| 3,933,147 | 1/1976 | DuVall | 128/788 |
| 4,007,735 | 2/1977 | Magnusson . | |
| 4,030,505 | 6/1977 | Tessler | 604/105 |
| 4,043,338 | 8/1977 | Homm et al. . | |
| 4,106,511 | 8/1978 | Erlandsson | 128/788 |
| 4,153,059 | 5/1979 | Fravel et al. | 128/422 |
| 4,154,242 | 5/1979 | Termanini . | |
| 4,192,294 | 3/1980 | Vasilevsky et al. | 128/328 |
| 4,432,758 | 2/1984 | Finegold | 604/104 |
| 4,535,759 | 8/1985 | Polk et al. . | |
| 4,564,024 | 1/1986 | Wohler, Jr. | 128/788 |
| 4,607,626 | 8/1986 | Borodulin et al. | 604/105 |
| 4,705,029 | 11/1987 | Borodulin et al. | 604/105 |
| 4,773,400 | 9/1988 | Borodulin et al. | 604/107 |

FOREIGN PATENT DOCUMENTS

| | | | |
|---|---|---|---|
| 73751 | 9/1917 | Austria . | |
| 458663 | 4/1928 | Fed. Rep. of Germany . | |
| 640126 | 12/1936 | Fed. Rep. of Germany . | |
| 2822616 | 11/1979 | Fed. Rep. of Germany | 128/421 |
| 185899 | 9/1887 | France . | |
| 520263 | 6/1921 | France . | |
| 540428 | 7/1922 | France | 128/32 |
| 2552663 | 4/1985 | France | 128/421 |
| 265400 | 11/1929 | Italy . | |
| 192355 | 4/1967 | U.S.S.R. | 128/32 |
| 1018630 | 5/1983 | U.S.S.R. | 128/421 |
| 1176901 | 9/1985 | U.S.S.R. | 128/421 |

OTHER PUBLICATIONS

Gierke, H. E., Oestreicher, H. L. Franke, E. K., Parrack, H. O. and Wittern, W. W.: Physics of Vibration in Living Tissues, J. Appln. Physiol. 4:886–900, 1952.

Sorbe, B., Frankendal, B.: Low-Frequency Vibration Dilation of the Uterine Cervix, Act. Radiol. Onc., 18: 554–560, 1979.

Leduc, A., Lievens, P. and Dewald, J., The Influence of Multidirectional Vibrations on Wound Healing and on Regeneration of Blood and Lymphvessels, Lymphology, 14:179–185, 1981.

(List continue on next page.)

*Primary Examiner*—Eugene H. Eickholt

*Attorney, Agent, or Firm*—Townsend and Townsend

[57] ABSTRACT

A method and apparatus for treating internal muscle and connective tissue disorders is disclosed. The method includes the steps of inserting a vibration source into a body cavity and applying vibratory massage in the form of expansions and contractions of the body cavity at a predetermined frequency. The apparatus includes a probe shaped for insertion into a body cavity, an actuator for causing the probe to expand and contract, and a mechanism for adjusting the frequency with which the probe expands and contracts.

42 Claims, 6 Drawing Sheets

OTHER PUBLICATIONS

Kuznetsova, M. N., Antipina, N. N., and Strugatsky, V. M.: Stepwise Physiotherapy of Central Menstrual Disorders in Young Girls, Akush. Ginekol. (Mosk.), 7:22–24.

Stewart, G. K., Margolis, A. J., Murr, W. and Kerner, J. A.: Cervical Dilation by Vibration. Obst. Gynec. 35:946–949, 1970.

Dahlgren, S.: Shortening of Labour, Especially the Period of Dilation with Low-Frequency Vibrations Against Cervix Uteri. Act. Obst. Gyn. Scan., 55:6–95, 1976.

Sorbe, B.: Concurrent Use of $PGF_{2a}$ Vibrations to the Cervix Uteri and Amniotomy to Induce Labor After Intrauterine Fetal Death, Int. J. Gynaecol Obstet., 17:246–249, 1979.

Lundeberg, T.: Long-Term Results of Vibratory Stimulation as a Pain-Relieving Measure for Chronic Pain, Pain, 20: 13–23, 1984.

Nathan, P.: Emptying the Paralysed Bladder, Lancet, I (Feb. 12): 377, 1977.

Medaer, R. and Kovacs, L.: Vibration-Assisted Bladder Emptying in Multiple Sclerosis, Lancet, 1 (8067): 768–9, 1978.

Bianchi, G., Frolov, K. V., Oledzki, A.: Man Under Vibration, Suffering and Protection, PWN-Polish Scientific Publishers, 1981.

VIBRATORY TREATMENT METHOD AND APPARATUS

CROSS-REFERENCES TO RELATED APPLICATIONS

This application is a sixth application and is a continuation-in-part of a Fifth application, Ser. No. 07/112,467, filed Oct. 26, 1987 now U.S. Pat. No. 4,773,400 granted Sept. 27, 1988.

Said Fifth application is a division of a Fourth application, Ser. No. 06/896,810, filed Aug. 15, 1986, now U.S. Pat. No. 4,705,029, granted Nov. 10, 1987.

Said Fourth application is a continuation-in-part of a Third application, Ser. No. 06/861,871, filed May 12, 1986, now abandoned.

Said Third application is a division of a Second application, Ser. No. 06/778,760, filed Sept. 23, 1985, now U.S. Pat. No. 4,607,626, granted Aug. 26, 1986.

Said Second application is a continuation-in-part of a First application, Ser. No. 06/621,842, filed June 18, 1984, now abandoned.

By referring to the prior applications and patents, we incorporate their disclosures in this application.

BACKGROUND OF THE INVENTION

The Therapeutic Effects Of Vibratory Stimulation

The therapeutic effects of vibratory stimulation on the human body have been well documented. Vibration applied to tissue increases blood circulation due to the increase in capillary dilation. The increased blood flow increases the consumption of oxygen and nutrients by muscles and improves the regeneration process. The result is an improved muscular tone, elasticity and contractile capacity. In addition, vibratory stimulation reduces tissue swelling, enhances healing of wounds and results in effective anti-inflamatory action.

The physiological effect of low frequency vibratory stimulation varies depending on the frequency, amplitude and duration of its application. Depending on the structure of the muscles (smooth or straiated), the same dose of local vibratory stimulation may cause either contraction or relaxation. A low frequency mechanical vibration of between 60 and 200 Hz applied to skeletal muscle induces a sustained contraction of the muscle and a simultaneous relaxation of its prime antagonists. This tonic vibratory reflex (TVR) is elicited in normal, spastic, paretic and myotonic muscles alike. Within the 60 to 200 Hz range, the vibration reduces the contractile force and tension of smooth muscle.

The most common therapeutic uses of vibratory stimulation involve external application of the vibratory forces. Vibratory stimulation is used for treating neuromuscular motor dysfunction in patients with cerebral palsy. External vibration is also used for treating patients with cervical osteochondrosis, lumbosacral radiculitis, postamputation contracture, sequelae of lesions of the long tubular bones, and chronic dental pain. Externally applied abdominal vibration is used for improving efficiency in peritoneal dialysis and for stimulating intestinal mobility in cases of intestinal atonia. External vibratory stimulation is also useful for bladder voiding in paralyzed patients.

Vibratory stimulation has also been used internally to relax and dilate the cervix prior to abortion or birth. Vibration accelerates expansion of the cervical opening, thereby facilitating parturition. The vibration is applied directly to the cervical muscle, and the source of the vibration is withdrawn as soon as the cervical dilation is achieved.

Vibration sources vary with the application. External vibration may be applied by large flat or rounded vibrating machines designed to be placed against the appropriate body parts. Internal vibratory stimulation of the cervix, on the other hand, may be applied by a vibrating spatula or a vibrating bullet shaped applicator placed against the wall of the cervical muscle.

Internally applied vibratory stimulation has not been used, however, for treating internal muscle and connective tissue disorders such as urethral strictures, urinary and anal incontinence, unstable bladder, and urethral syndrome. The prior art methods of treating such disorders is discussed below.

Urethral Strictures

Urethral strictures, especially posttraumatic ones, are very dense, rigid, and resistant to stretching. They are localized mostly in the membranous or bulbous parts of the urethra. A non-surgical method for treating urethral strictures, known as bougienage, involves probing such strictures with elongated members or probes to enlarge them.

Such probes are known as bougies. Conventional bougies are shown in the text "Urology", 3d ed., v.1, p. 242, M. F. Campbell and J. H. Harrison, eds. (Saunders, 1970). Such bougies are solid metal or plastic rods which are shaped to accommodate the physiological curvature of the urethra. In males the urethra's outer part is within the highly flexible pendulus of the penis and can be bent or straightened as necessary. The urethra's inner part extends around the pubic articulation and is therefore curved. Thus, conventional bougies generally comprise a straight portion extending from the handle, followed by a curved portion adjacent the tip. This shape corresponds to the urethra when the penis is straightened.

Despite the correspondence in shapes, the insertion of a conventional bougie in males is a very complicated and painful operation, requiring high skill and concentration. Usually, the urologist will employ a set of bougies of gradually increasing diameter. The results of treatment with such instruments are not always positive; complications such as bleeding, perforations of the urethral wall and other injuries, urinary fever, prostatitis, epididymitis, and the like may occur. Even in females, whose urethras are shorter and straighter, many of these difficulties are encountered. Moreover, the conventional bougie is used only for dilation and cannot be utilized for vibratory stimulation.

Urinary Incontinence

Urinary incontinence is a distressing and previously neglected condition which can result from a range of pathological processes in the central or peripheral nervous system, the bladder, or the urethra. The disorder is related to faulty storage or deficient control and is difficult to treat.

Incontinence can affect all ages. Several reports have shown that 16–50% of nonparous females admit to the loss of a small amount of urine during hard coughing, laughing, or sneezing, particularly if the bladder is excessively full. Five percent of women between the ages of 15–34 and about 10 to 26% in ages of 35–60 reported regular troublesome stress urinary incontinence. As is shown by both European and American researchers, urinary incontinence is a problem affecting 10 to 40% of the elderly women in the community and up to 50% of the elderly in institutions. Urinary incontinence is therefore a major geriatric problem with substantial medical and social implications.

Stress urinary incontinence is defined as the involuntary loss of urine through the intact urethra as the result of a sudden increase in intra-abdominal pressure in the absence of bladder activity. Stress urinary incontinence accounts for roughly 75% of all female urinary incontinence.

The most frequent cause of stress urinary incontinence in females is the poor function of the sphincteric mechanism of the urethra and an inadequate pelvic floor function. The key factor in the development of stress incontinence in females is an inherent weakness in the mechanism of urinary continence upon which precipitating factors exert influence. Typically the problem occurs in women in whom childbirth causes long-term anatomic damage and a relaxation in the pelvic and periurethral musculature. The percentage of such women comprises about 52.2% of the total number of stress urinary incontinence sufferers.

Menopause is another very important precipitating factor in the development of stress incontinence. Hormonal dysfunction in postmenopausal women is characterized by estrogen deficiency and leads to atrophy of pelvic tissues. This can distort local anatomy and result in stress incontinence.

Involuntary detrusor contractions are also a common cause of urinary frequency, urgency, nocturia, bed wetting, urge incontinence, and the like. Abnormalities of detrusor contraction may be of myogenic, neurogenic, or psychoplogic origin. In the absence of a neurologic lesion, the condition is termed "detrusor instability." The unstable bladder is a very common problem affecting as much as 10% of the population and a substantially higher percentage at the two extremes of life. In most cases the etiology of the detrusor instability remains unknown, since these patients are referred to as having "idiopathic" detrusor instability. As a result, the treatment of detrusor instability is difficult.

Conventional treatment of urinary incontinence falls into four main categories: surgery, drug therapy, re-education, and, where necessary, the use of protective clothing, tampons, vaginal appliances designed to support the urethra, and indwelling catheters. These treatments are discussed below.

There are over 50 surgical procedures designed to correct urinary incontinence. The success of these procedures, however, is much higher in younger women than in the elderly. Approximately 10–40% of women who undergo surgical correction of urinary stress incontinence will have recurrent urinary incontinence and other voiding difficulties. Surgery is not effective when the problem is an unstable bladder or intrinsic urethral abnormalities, and the condition of the patient after surgery in this case can worsen.

The surgical method is generally accepted as the most appropriate treatment for severe female genuine stress incontinence. In a number of cases, this method is also used for treating patients with a mild-to-moderate form of incontinence.

The trend in the profession, however, is to avoid surgical therapy if possible. In addition, there are some patients for whom surgery is inappropriate. For example, women who wish further pregnancies would be poor candidates since later vaginal deliveries may adversely affect successful surgery.

New surgical techniques such as electronic stimulation of sphincters and implantations of artificial sphincters are widely used for treating patients with urinary incontinence caused by surgical traumas or by organic neurologic dysfunctions. Although these new methods give promising results, they still require further clinical studies as well as improvements in devices necessary for implementation of these methods.

Drugs of several types also have been recommended for treating stress urinary incontinence. These drugs are nonspecific, however, and therefore act on structures and viscera other than the bladder and urethra. Large doses are often required, and toxicity can easily be reached before the desired effect on the bladder and urethra is achieved. Moreover, even when drug treatment is effective, it does not lead to restoration of a normal micturition pattern.

Re-education for incontinence includes bladder re-training programs and re-education of the pelvic floor muscles. The bladder re-training method consists of instituting a program of scheduled voidings with a progressive increase in the interval between each micturition. A four to six week treatment program is common.

Two different methods of electrical stimulation for the correction of urinary incontinence are in use and are classified according to the time of application and the intensity of electrical stimuli: long-term, or chronic, electrical stimulation and short-term, or maximum, electrical stimulation. Long-term electrical stimulation is continued 6–20 hours daily for prolonged periods of from 3 to 36 months and short-term, or maximum, electrical stimulation is continued 20–30 minutes over a one-month period, the stimulation being applied 1–5 times a day. Electrostimulation has been found to be valuable in cases of urinary urge incontinence due to detrusor instability since it is more effective than drug treatment and can produce re-education of incontinence. The mechanisms behind this curative effect are not yet defined, however.

Exercise therapy, which is a natural biological and non-invasive functional method of treatment, plays a leading role in non-surgical methods of treatment of stress urinary incontinence, as this method positively effects a weakened muscular-ligamentous apparatus of the pelvic floor. The exercise is designed to strengthen the urethral and periurethral striated muscles. Physiotherapy consists of four or five pelvic floor contractions repeated every hour and interrupted micturition practiced on each occasion. In the beginning, the treatment is carried out on a hospital basis for four weeks followed by self-treatment for a prolonged period of time.

As a rule, all the non-surgical methods of treatment of urinary incontinence described above are lengthy and required repeated courses of treatment. In addition, the long-term results of these types of treatment are largely unsuccessful. In spite of a large number of investigations dedicated to urinary incontinence, this problem is still far from being resolved.

Urethral Syndrome

Urethral syndrome is a condition indicating lower urinary tract symptoms, such as frequency and dysuria in the absence of obvious bladder or urethral abnormality where the urine is sterile or contains less than $10^5$ microorganisms per mL. Urethral syndrome has been estimated to occur in 20–30% of all adult females.

One cause of urethral syndrome is extra-urethral pathology which is revealed in the form of changes in connective tissues between the urethra and the vagina (the urethrovaginal septum). This is expressed in an increased amount of collagenous tissue in the above-mentioned area which, in turn, may lead to obstruction. Thus, vaginitis can produce dysuria and frequency by contingous involvement of the periurethral area.

Because urethral syndrome is caused by many different etiologic factors, the treatment of this condition is difficult. Treatment modalities range from an operative technique to a local application of silver nitrate, antibiotics, estrogens and steriods, as well as psychotherapy.

Urethral dilation and manual massage has been recommended as treatment for urethral syndrome. Such treatment is typically performed with a rigid surgical instrument on which intravaginal massage of the urethral wall can be performed.

Abnormally high and varying tensions within the voluntary sphincter of the urethra and cardinal functional changes produces the urethral syndrome in women. When spasm is found as the cause of urethral syndrome, both smooth and skeletal muscle relaxants have been given for the relief of symptoms. Unfortunately, repeated courses of this treatment often have little therapeutic value. Urethral dilation is also less effective in these patients.

After a physiological menopause, hypoestrogenism occurs and retrogressive (senile) changes take place in the vaginal and urethral mucosa. The treatment of urethral syndrome secondary to hypoestrogenism is oral and topical vaginal estrogen.

In spite of a great number of reports dedicated to this subject, a considerable number of problems relating to etiology, pathogenesis, and treatment as yet remain unsolved. Irrespective of long-termed and repeated courses of treatment, urethral syndrome often recurs.

Object of the Invention

The existing methods for treating the internal muscle and connective tissue disorders discussed above have proved to be inadequate. Therefore, a more effective method and apparatus to treat these and other internal disorders is needed. Thus, the main object of this invention is to provide an apparatus and method for the vibratory treatment of internal muscle and connective tissue disorders.

SUMMARY OF THE INVENTION

Our invention is a method and apparatus for treating internal muscle and connective tissue disorders using vibratory stimulation and massage. According to the invention, an instrument having a probe and an actuator is inserted into a body cavity. The probe has a plurality of flexible elements which are bound together at one end. The probe is attached to a reciprocal actuator at the unbound end of the flexible elements. Once inserted into the body cavity at the point at which the treatment is to be applied, the actuator is activated to cause the probe to vibrate by expanding and contracting, thus massaging and stimulating the tissue adjacent the body cavity.

Figure 18:
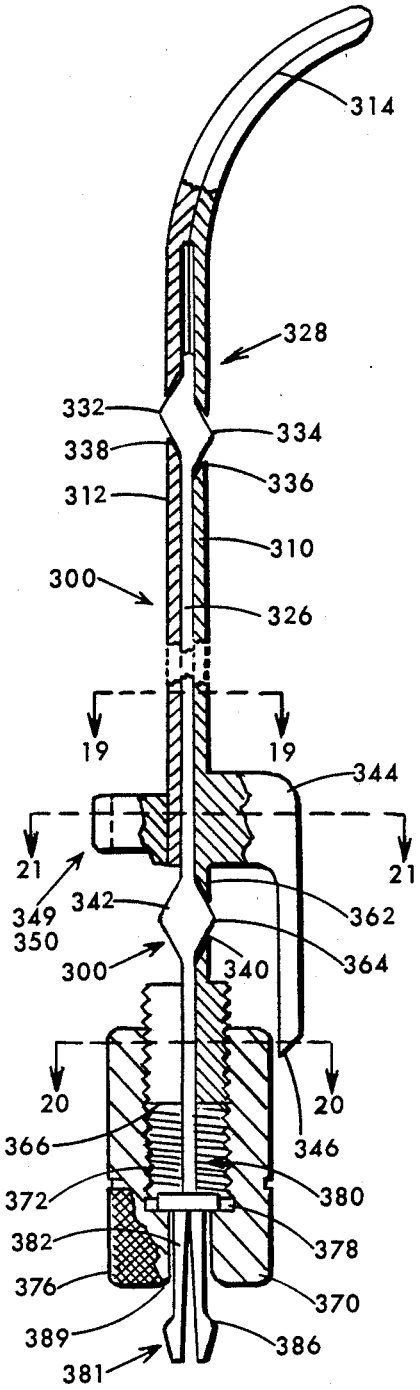
FIG. 18 shows a longitudinal sectional view of a bougie according to a sixth embodiment of the invention.

FIG. **18*a* is a partial top view of the bougie of FIG. 18** showing the position of a pointer with respect to the scale.

Figure 19:
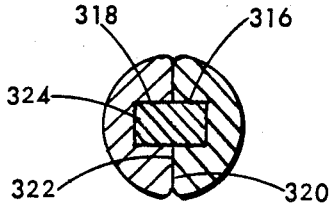

FIG. 19 is a cross-sectional view along the lines 19—19 in FIG. 18.

Figure 20:
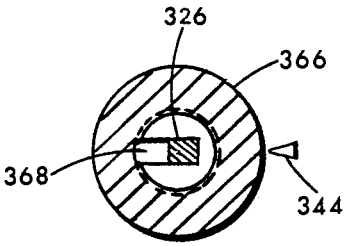

FIG. 20 is a cross-sectional view along the lines 20—20 in FIG. 18.

Figure 21:
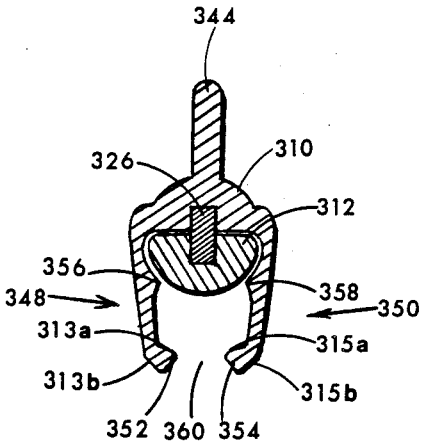

FIG. 21 is a cross-sectional view along the lines 21—21 in FIG. 18.

Figure 22:
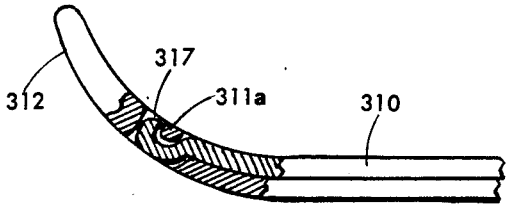

FIG. 22 is a side partially-sectional view of the bougie of FIG. 18.

Figure 23:
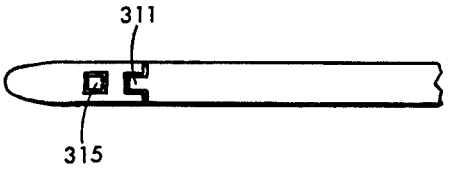

FIG. 23 is a top view of the part of the bougie shown in FIG. 22.

DETAILED DESCRIPTION OF THE PREFERRED EMBODIMENTS

The preferred embodiments of the apparatus of the invention and the preferred methods of using these embodiments will be described with reference to treating urethral strictures. It should be understood, however, that this apparatus and method may be used to treat other internal muscle and connective tissue disorders as well.

Figure 1:
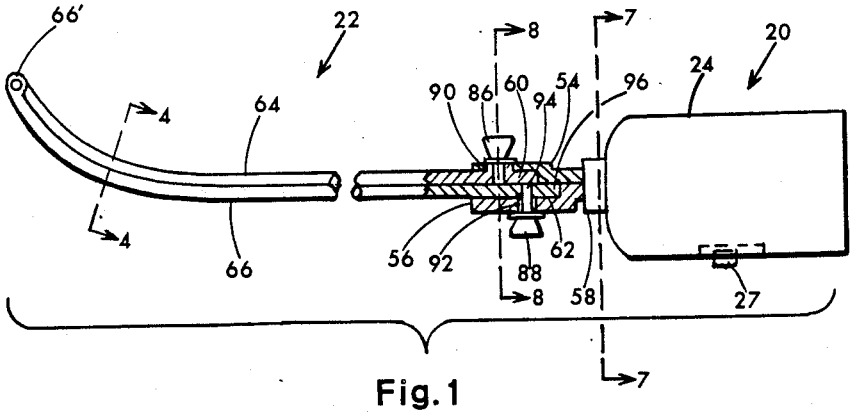
FIG. 1 is a partial section view of a mechanically-driven bougie.

FIG. 1—Mechanically-Expandable Bougie

Figure 2:
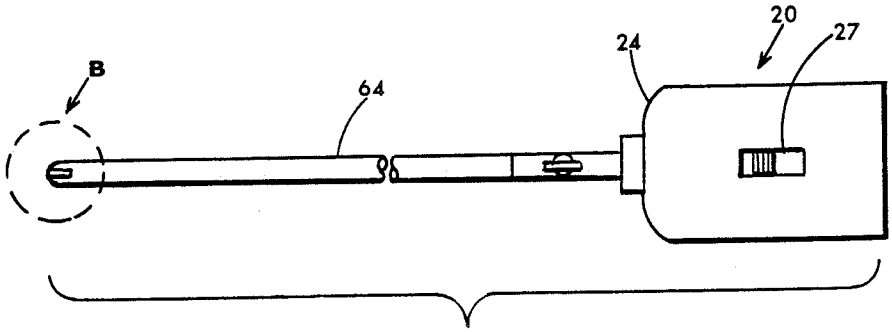
FIG. 2 is a general view of the bougie of FIG. 1.

As shown in FIGS. 1 and 2, the bougie according to a first embodiment consists generally of two main units, i.e., a drive unit 20 and a probe 22 which is attached to drive unit 20 in a manner described in detail below.

Drive unit 20 may be a conventional commercially available device, such as a drive unit for an electric knife with two blades which reciprocate in opposite directions. Unit 20 includes a housing 24 with an electric motor (not shown) and a supply cord (not shown) for connection to a conventional electric power source (not shown), preferably a storage battery, to prevent electric injuries in case of a short circuit and patient grounding. The rotational speed of the motor may be adjusted, e.g., by means of a sliding knob 27 which controls a speed control (not shown).

Unit 20 has two output sliders 54 and 56 which protrude from a tubular output end 58 of housing 24 (FIG.

7). When the instrument is operated, sliders 54 and 56 reciprocate in opposite directions, their speed being controlled by knob 27. Housing 20 may also include stroke-length adjustment means (not shown). The sliders have recesses 60 and 62, respectively (FIG. 1), for receiving the shank portions of probe 22.

Figure 4:
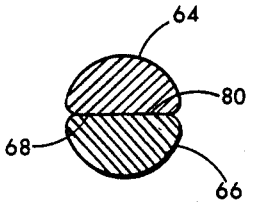
FIG. 4 is a cross-sectional view along lines 4—4 of FIG. 1.
Figure 8:
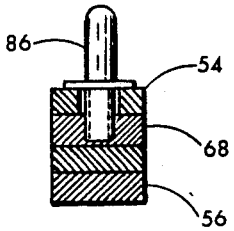
FIG. 8 is a cross-sectional view along lines 8—8 of FIG. 1.

Probe 22, the insertable part of the bougie, consists of two flexible, tapering rods 64 and 66 of semicircular cross sections (FIG. 4). Shank portions 68 and 70 of probe 22 are thicker and more rigid and have rectangular cross sections, as shown in FIG. 8, so as to be accommodated in rectangular recesses 60 and 62 of sliders 54 and 56, respectively. Preferably rods 64 and 66 are made of stainless steel and are about 30 mm long and 4.5 mm in diameter.

Figure 5:
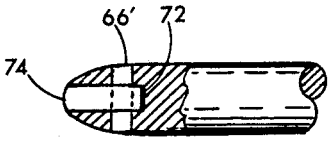
FIG. 5 is an enlarged view of element B of FIG. 2.

The front ends of rods 64 and 66 are pivotally connected to each other by a pivot pin 66'. As shown in FIG. 5, which is an enlargement of area B of FIG. 2, either rod 64 or rod 66 has a fork-shaped end with a slot 72. A protruding portion 74 of the complementary rod is inserted into this slot so that both rods 64 and 66 can be pivotally interconnected by a pin 66'.

As shown in FIG. 4, in a folded or working state, rods 64 and 66 form a complete circle when seen in cross section, except for chamfered or rounded edges at opposite sides on mating surfaces 78 and 80. These rounded edges prevent pinching of mucosa during operation of the tool. The front end of probe 22 is also rounded. Thus, in its working or folded state, the probe corresponds in its shape to a conventional bougie. However, it is made smaller in diameter than a conventional bougie because it has a capacity to expand, as explained below. In fact, it corresponds in size to the smallest bougie of a conventional set and thus can be easily inserted into the urethra. Moreover, it can act inside the urethra more efficiently than the largest diameter bougie in a conventional set due to its ability to provide vibrational and massaging effects to strictures and their surrounding tissue. Also, as with a conventional bougie, it has a diameter which gradually narrows and flattens towards the tip so as to facilitate insertion.

Figure 3:
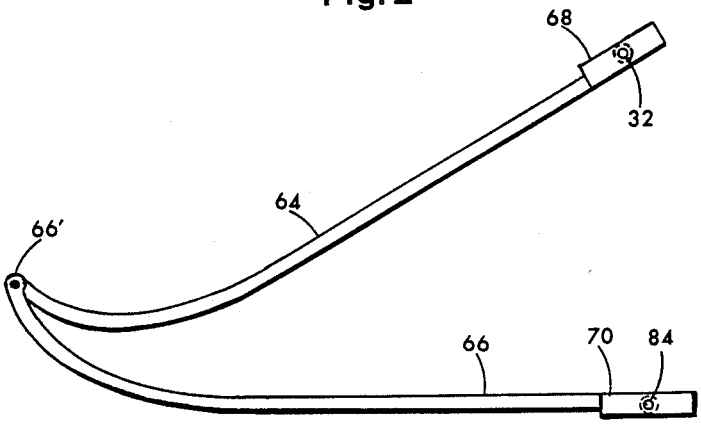
FIG. 3 is a view of a probe of the bougie of FIG. 1.

In its rectangular shank portions 68 and 70, rods 64 and 66 have threaded holes 82 and 84 (FIG. 3). Screws 86 and 88 are threaded through holes 82 and 84 and mate with corresponding holes 90 and 92 in the protruding portions of sliders 54 and 56. These screws and holes are used for attachment of rods 64 and 66 to their respective sliders. In recesses 60 and 62 of the sliders, stop surfaces 94 and 90 are provided. The ends of shank portions 68 and 70 rest against these stops in order to align threaded holes 82 and 84.

Probe 22 can be made of any suitable material which is durable, flexible, and hygienically acceptable for sterilization and insertion into the urethra. For example, it can be made of stainless steel or plastic, such as polycarbonate, PFTE, etc.

FIGS. 1 to 8—Operation

Probe 22 is folded and is attached to drive unit 20 by means of screws 86 and 88. For this purpose, shank portions 68 and 70 are pressed against stop surfaces 94 and 96 of respective sliders 54 and 56, whereupon threaded holes 82 and 84 will be aligned with holes 90 and 92 of the sliders. Each shank is attached to its corresponding slider by screws 86 and 88, respectively.

For treating urethral strictures, a special gel for lubrication and anesthesia is introduced into the bladder. The bladder is filled with 150 ml. of sterile saline. Probe 22 is inserted into the urethra of the patient in the usual manner with the motor of drive unit 20 still off. This procedure is made less painful and less dangerous because of the smaller diameter of bougie 22.

When the expandable part of probe 22 reaches the constricted portion of the urethra, the motor of driving unit 20 is turned on. When the motor rotates, sliders 54 and 56 will reciprocate in mutually opposite directions.

As a result of their mutually opposite reciprocations, their flexibility, and their tip attachment by pivot pin 66', the front portions of rods 64 and 66, which are highly flexible due to their reduced diameter, will be repeatedly forced to separate from each other. I.e., they will repeatedly assume the separated positions shown in FIG. 6 and then contract, thereby expanding and contracting probe 22 radially.

Figure 6:
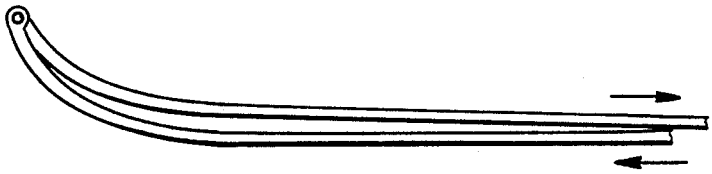
FIG. 6 is a working portion of the bougie of FIG. 1 in an expanded position.
Figure 7:
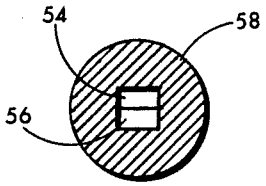
FIG. 7 is a cross-sectional view along lines 7—7 of FIG. 1.

Specifically, when the upper rod is pulled back toward the motor and the lower rod is pushed forward as indicated in FIG. 6, the force will tend to shorten the upper rod, which will remain straight. However, the lower rod, being fixed at its distal tip by reason of its connection to the upper rod and being pushed out from its proximal end, will tend to lengthen and thus will bow out at its most flexible free part, i.e., near its tip.

Thereafter, lower rod 66 will be pulled back and upper rod 64 pushed out, causing both rods to straighten, and then causing the lower rod to bow and the upper rod to straighten (not shown), and so on.

These expansions and contractions will occur at a frequency controlled by knob 27 on the housing of driving unit 20. The frequency is selected according to the type of treatment being given to the patient (dilatation of the stricture, massage of the urethra, massage of the neck of the bladder, etc.), but usually it should be within the limits of from 5 to 60 Hz, preferably, from 10 to 30 Hz. The duration of treatment also can vary, depending on many factors, such as the type of disease, condition of the patient, etc.

When the procedure is over, the motor is turned off and probe 22 is extracted from the urethra. After extraction, the actuating tool is disconnected from drive unit 20, sterilized, and is ready for reuse. Treatment should be repeated daily for four to six weeks.

Other Modifications

Other modifications of the bougies are possible. For example, only one of the rods of the actuating unit may be movable. Cam or eccentric-type mechanisms can be used instead of the crank mechanism shown in the illustrated embodiments. The bougie can be made of materials other than plastic or stainless steel, and the cams can be located in the vicinity of the tip or in any other place on the rods. Also, while the bougie has been discussed for use in urological applications, it and other probe-like instruments can be used in many other applications, including animals or inanimate objects, where an expandable probe is desired. For example, the bougie can be used for vascular dilation in cranial, cardiac, and extremity applications. Also, it can be employed in any conduit or duct in mechanical, plumbing, and laboratory applications and the like where constriction, stenosis, or wall fusion of any lumen is encountered.

Figure 9:
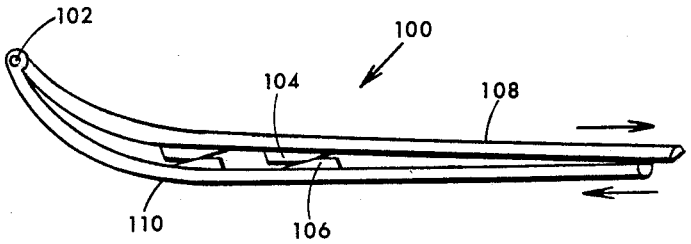
FIG. 9 is a side view of a bougie according to a second embodiment of the invention.

FIG. 9—Bougie with Overriding Cams

In some patients, urethral constrictions may have a considerable length. For treating such patients, the tool of FIG. 9, which uses overriding cams, is most suitable.

The mechanically-driven tool of this embodiment has the same drive unit 20 as used in the embodiment of FIGS. 1 and 2 and differs only in its probe 100.

Probe 100 has two rods 108 and 110. At its proximal part, remote from tip 102, mutually engaging cams 104 and 106 are formed on the mating surfaces of rods 108 and 110.

During operation of the tool, rods 108 and 110 reciprocate in mutually opposite directions. This causes cam 104 of rod 108 to override cam 106 of rod 110, causing the rods to separate and expand in the vicinity of the tip portion and in the region of cams 106 and 104. Thus, a longer portion of the probe expands and contracts, enabling a longer portion of the urethra to be treated. The insertion, control, and extraction of the tool are carried out in the same manner as has been described for the first embodiment of the invention.

Figure 10:
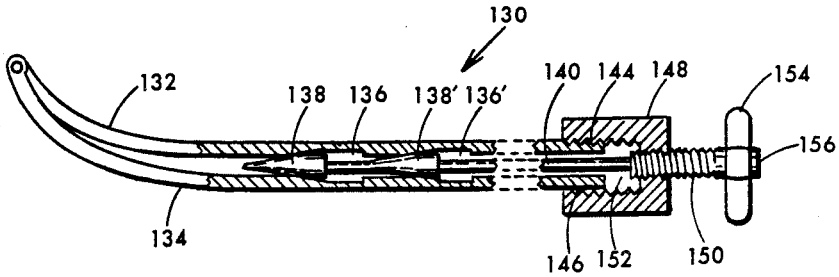
FIG. 10 is a longitudinal partially-broken view of a bougie according to a third embodiment of the invention.
Figure 11:
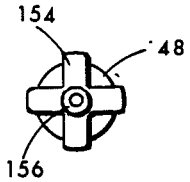
FIG. 11 is a view taken from the right side of FIG. 10.

FIGS. 10 and 11—Manually-Rotatable Bougie with Wedges

A third embodiment of a manually-driven mechanically-expandable bougie is shown in FIGS. 10 and 11. FIG. 10 is a longitudinal, partially-broken-away view of a probe 130. As in the previous modification, probe 130 consists of a pair of pivotally interconnected rods 132 and 134 of a semicircular cross section which together form a complete circle. Recesses 136 and 136' are formed in the respective rods 132 and 134, respectively. In an assembled state, these recesses form closed cavities which accommodate cams or wedges 138 and 138', respectively. Wedges 138 and 138' are attached to a rigid core or rod 140 which passes through a smaller diameter recess 142 formed between rods 132 and 134.

The rear end of core 140 protrudes outside probe 130. The rear ends of rods 132 and 134 have grooves 144 and 146 which cooperate to form a complete thread when the bougie is assembled. A nut 148 is screwed onto this thread in order to fix the proximal end of the bougie and at the same time to provide a handle for a urologist who uses the bougie. The shape of this handle is shown in FIG. 11, a view taken from the right side in FIG. 10.

The protruding end of core 140 is threaded at 150 so that it can mate with the inner thread in the hole 152 of nut 148 through which core 140 protrudes. The rear end of core 140 has a handle 154 rigidly attached thereto, e.g., by a bolt 156.

In operation, bougie 130 is inserted into the urethra in a conventional manner and then is expanded mechanically by rotating handle 154 in the direction which provides forward movement of wedges 138 and 138'. In the course of its forward movement, the wedges will cause rods 132 and 134 to move apart, thereby increasing the diameter of the probe. Handle 154 is repeatedly rotated in forward and reverse directions of periodically expanding and constricting the probe, thereby to impart a massaging action to the surrounding tissue of the urethra.

Figure 12:
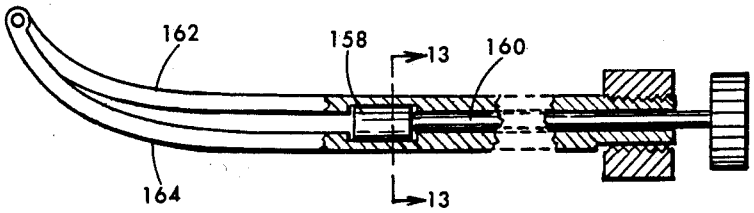
FIG. 12 is a view of a bougie according to a fourth embodiment of the invention.
Figure 13:
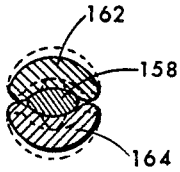
FIG. 13 is a cross-sectional view along lines 12—12 of FIG. 12.

FIGS. 12 and 13—Manually-Operable Bougie with Rotatable Cams

FIGS. 12 and 13 illustrate a fourth embodiment of a bougie of the invention. This embodiment is generally similar to the embodiment shown in FIGS. 10 and 11, but differs in that a rotatable cam or eccentric element 158 is attached to a core 160 instead of reciprocating wedges 138 and 138'.

During manual forward and reverse rotation, cams 158 will rotate, causing semicircular rods 162 and 164 to expand, periodically assuming the positions shown by the broken lines in FIG. 13.

FIGS. 14 to 17—Bougie with Protruding Wedge—Description

An embodiment of a mechanically-expandable bougie having a protruding wedge is shown in FIGS. 14–17.

Figure 14:
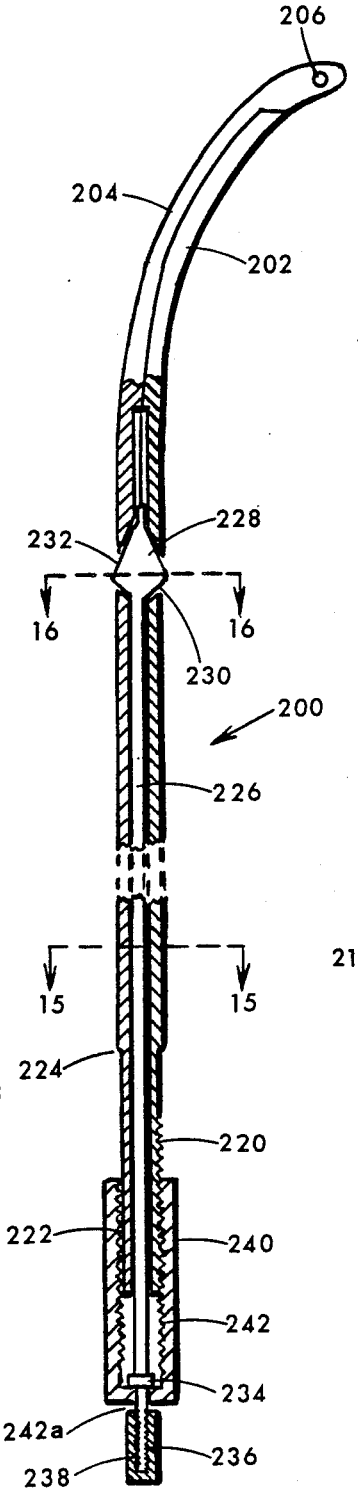
FIG. 14 shows a cross-sectional view of a bougie according to a fifth embodiment of the invention.
Figure 17:
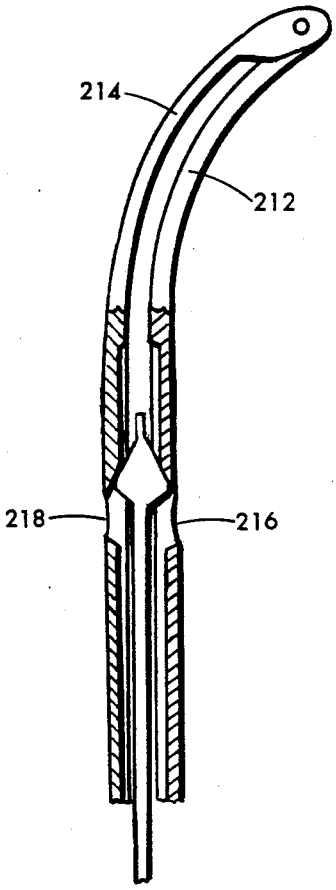
FIG. 17 shows a partial sectional view of the bougie of FIG. 14 in an expanded condition.

FIG. 14 is a longitudinal sectional view of a bougie 200. It consists of a pair of rods 202 and 204 pivotally connected at their front ends by a pivot pin 206.

Figure 16:
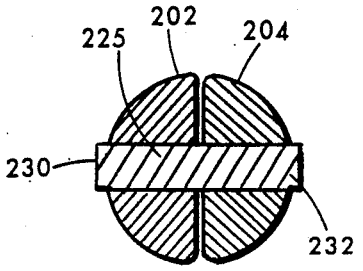
FIG. 16 shows a cross-sectional view taken along the line 16—16 of FIG. 14.
Figure 15:
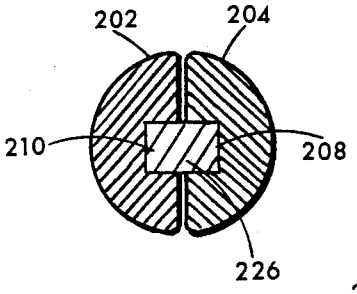
FIG. 15 shows a cross-sectional view taken along the line 15—15 of FIG. 14.

As shown in FIGS. 15 and 16, which are crosssectional views along lines 15—15 and 16—16, respectively, both rods have a semicircular cross sections so that in an assembled state of the bougie, they form a complete circle.

Longitudinal grooves 208 and 210 are formed on mating inner surfaces 212 and 214 (FIG. 17) of the rods. Aligned holes 216 and 218 (FIG. 17) are formed in the front portion of the bougie, i.e., at a distance from $\frac{1}{8}$ to $\frac{1}{3}$ of the length of the rods from the point of their pivotal interconnection. These holes extend from the bottoms of respective grooves 208 and 210 to the peripheries of the respective rods.

Grooves 208 and 210 are shallower adjacent the front end of the bougie, ahead of holes 216 and 218, than they are behind these holes.

The rear end of rod 202 is threaded at 220. The other rod, 204, is not threaded at its rear end 222, but rather has a smaller diameter than the inner diameter of threads 220. A shoulder 224 is formed between smaller diameter portion 222 and larger diameter portion 225 of rod 204.

Rods 202 and 204 sandwich a longitudinal core element 226 in the guide slot formed by grooves 208 and 210. Core element 226 can slide freely in this slot. This core element has a flat (two-sided) wedge portion 228 on its front end. Wedge portion 228 has opposing lobes 230 and 232. The width of wedge portion 228 exceeds the diameter of the rods in their assembled state. Thus, when wedge portion 228 is aligned with holes 216 and 218, its lobes 230, 232 protrude outwardly beyond the peripheries of the rods. The height of these protruding portions is preferably between 0.06 to 1.20 mm.

The rear end of core element 226 has an annular collar 234 of a slightly larger diameter than the front part of the element. The rear end of element 226 behind the collar is threaded at 236. A nut 238 is screwed onto this threaded portion. As shown, the depth of the threaded hole in nut 238 is shorter than the threaded rear end of element 226, thus creating a gap (as shown) between nut 238 and sleeve 240.

Sleeve 240, which has inner threading 242, is screwed onto thread 220 of rod 202. Sleeve 240 has an opening **242*a* in its rear end. The diameter of this opening is smaller than the diameter of annular collar 234, but is larger than the external diameter of thread 236**.

FIGS. 14 to 17—Operation

The bougie shown in FIGS. 14 to 17, can be used in two different modes.

According to the first mode of operation, core element 226 is not used and thus is removed from the device. After insertion into the urethra, the bougie is expanded to a required diameter by merely rotating sleeve 240 clockwise when seen from the rear end of the device. When sleeve 240 is turned, it will move forward until its front end abuts shoulder 224. Rod 204, which has no thread to engage with inner thread 242 of sleeve 240, will remain stationary, whereas rod 202 will be pulled backward because its thread 220 engages with inner thread 242 of sleeve 240. This causes rod 204 to deform and hence to expand outwardly from rod 202. This expansion dilates the urethral stricture or the urethra itself.

In the second mode of operation, the bougie is used in combination with longitudinal core element 226.

First the bougie is assembled as shown in FIG. 14 so that wedge 228 is aligned with holes 216 and 218 and its lobes 230 and 232 project outward beyond the peripheries of the rods. The bougie is then carefully inserted into the urethra. Until the protruding lobes come into contact with the urethral stricture, the probe can be easily moved forward. The moment of contact of lobes 230, 232 with the stricture can be distinctly felt by the urologist; this will be a signal that the expansion operation should be commenced.

To expand the bougie, sleeve 240 is manually rotated. Since the threads of sleeve 240 mate with threads 220 of element 226, sleeve 240 will move axially toward the front end of the bougie. Since the inner rear shoulder of sleeve 240 engages annular collar 234 of core element 226, axial movement of sleeve 240 will be transmitted to core element 226 and axial movement of sleeve 240 will be transmitted to core element 226. Element 226 will move forward with respect to rods 202 and 204. Core element 226 is guided in the slot. Lobes 230 and 232 of element 226 will engage the edges of holes 216 and 218 and cam rods 202 and 204 outwardly. Expansion will take place because grooves 208 and 210 have a smaller depth at the front part of the probe, i.e., in front of the holes, and because of the wedging action of the core.

If difficulties occur in returning the core element to its initial position before extraction of the bougie from the urethra, nut 238 can be used as an auxiliary means to facilitate the return of the core element to its initial position.

FIGS. 18 to 23—Bougie with Multiple and Offset Wedges—Description

Another embodiment of a mechancially-expandable bougie, here with a shortened rod, is shown in FIGS. 18 to 23.

FIG. 18 is a longitudinal sectional view of a bougie 300. The bougie is formed of two rods 310 and 312. Each rod has a semicircular cross section. When the rods are placed adjacent one another, flat sides facing, they form a complete circle. In their longitudinal view the rods in assembled state correspond to the shape of a conventional solid urological bougie, i.e., to the shape of the urethra. At their end distal from the actuating and holding and control end, i.e., the left end in FIG. 18, such interconnection preferably is by means of a permanent or disconnectable pivot (in case of metal), or by thermal fusion of an adhesive substance 314 (FIG. 18) acceptable for medical applications (in case of plastic). The structure of the disconnectable pivot will be discussed later in connection with FIGS. 22 and 23.

Similar to the construction shown in FIG. 14, the rods have guide grooves 316 and 318 (FIG. 19) on their mating flat surfaces 320 and 322. When the rods are assembled face-to-face, these grooves form a closed rectangular guide slot 324 (FIG. 19). Slot 324 runs for about 9/10 the length of the rods. In one embodiment the rods were 33.6 cm long (horizontal length) and slot 324 was 29.8 cm long and started 3.8 cm from the proximal end (horizontal length). The grooves are shallower in the first third of their length, i.e., the straight portion of the bougie. Specifically, they are about 1.5 mm deep in the first third of the bougie and about 2.0 mm deep for the rest of the bougie.

A central rod 326 is inserted into slot 324. In contrast to the previous embodiment of the invention, central rod 326 has several camming or wedging elements. In the illustrated embodiment two such elements (328 and 330) are shown. These two wedging elements or lobes are used for providing uniform expansion of the bougie over its entire working length. First wedging element 328, closer to the distal end, has two camming lobes, 332 and 334, which project in opposite directions radially and slightly offset with respect to one another axially. Rod 326 is about 29.3 cm long and has a rectangular cross section about 3.0 mm×2.0 mm. Wedging elements 332 and 334 are triangular in shape and have a height of about 4.5 mm and a base length of about 14 mm.

Rods 310 and 312 have holes 336 and 338, respectively, through which lobes 332 and 334, respectively, project radially outwardly, beyond the peripheries of the rods.

Wedging element 328 provides expansion essentially of the front or proximal part of the bougie. Its rear or distal part is expanded by means of a wedging element 330 which has symmetrical lobes 340 and 342 which are not offset axially.

At its rear or proximal end, top rod 310 has an L-shaped projection 344 which serves as a holder or a handle for the urologist and at the same time as a pointer (FIG. 18*a*) which indicates the degree of expansion of the bougie, as will be explained later. Handle projects upward about 2.2 cm and its horizontal portion is about 6.8 cm long.

On the side of rod 310 diametrically opposite to handle 344, are two projections 348 and 350 (FIG. 21) which in cross section form a U-shaped configuration. On their free ends, projections 348 and 350 have inwardly directed ears 352, 354, and in their central part projections 348 and 350 have inwardly directed ribs 356, 358. Projections 348 and 350 are about 1.8 cm long (vertical dimension in FIG. 21), have an overall width of about 1.5 cm (horizontal dimension in FIG. 21) and are about 0.8 cm wide (horizontal dimension in FIG. 18). Ribs 356 and 358 are about 1.0 mm high and are about 0.8 cm long.

The inside of projections 348 and 350, above ribs 356 and 358, form a guide slot for rods 310 and 312 when they are assembled and form a complete circle in their cross section.

Projections 348 and 350 are sufficiently elastic so that rod 312 can be pulled down past ribs 356 and 358 and into the lower space between the ribs and ears 352 and 354. However, gap 360, between ears 352 and 354, is small enough to keep rod 312 from passing beyond the ears under gravity but allows its intentional withdrawal and insertion. For this purpose, camming surfaces 313*a* and 313*b* are formed on both sides of lug 352, and similar camming surfaces 315*a* and 315*b* are formed on lug 354.

Rod 312 is shorter than rod 310 and terminates approximately slightly beyond projections 344 and 348. I.e., rod 312 is about 27.3 cm long, while rod 310 is about 29.8 cm long. In their assembled state, rods 310 and 312 have a diameter of about 0.7 cm.

Part 362 of rod 310, adjacent and to the rear of handle 344, has a through opening 364 for projection 340. At its rear end, which follows directly after part 362, rod 310 has a threaded portion 366. As shown in FIG. 20, threaded portion 366 has a longitudinal slot 368 which is cut from its inner surface into the body of portion 366. Slot 368 is about 15 mm long, about 2 mm wide, and about 14 mm deep. This slot serves as a guide for central rod 326 and allows rod 312 to be inserted and withdrawn.

Figure 18A:
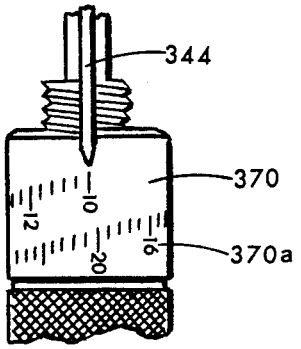

Threaded onto portion 366 is a cylindrical head 370 which has an inner thread 372 which mates with the thread on portion 366. The outer surface of head 370 has a scale 370*a* (FIG. 18*a*). The free end 346 of handle 344 serves as a pointer (FIG. 18*a*) to indicate the degree of expansion of the bougie. This is possible because the degree of rotation of head 370 is proportional to axial displacement of wedging elements 328, 340, and thus to the degree of radial expansion of the bougie. The scale on head 370 may be calibrated in French units (one unit=0.33 mm) which are normally used for indicating the sizes of bougies.

Near its rear end, central rod 326 has a collar 376 which rests on a support surface 378 in the threaded bore 380 of cylindrical head 370. The rear end of central rod 326 projects beyond its collar and head 370 and has a split part 381 which, when squeezed, can pass through rear end hole 382 in head 370. This allows for insertion and extraction of central rod 326 when assembling and disassembling the instrument.

Split part 381 has, on its side which faces the rear end of head 370, an abutting convex surface 386, and mating concave recess 388 is formed in the mating surface of head 370.

Rod 310 can be disconnected from rod 312, as shown in FIGS. 22 and 23. FIG. 22 is a side, partially sectional view and FIG. 23 is a top view of the attachment.

In the embodiment shown, rod 310 has at its proximal end a tongue 311 which is narrower than the body of the rod (FIG. 23). Tongue 311 has an inclined groove 311*a* (FIG. 22) so that in its side view the proximate end of rod 310 has an oblique, U-shaped configuration.

The mating part of rod 312 has a square opening 315 into which a tooth 317 formed by the front leg of the U-shaped portion of rod 310 is inserted. Inclination of groove 311*a* provides a camming action which interlocks the rods, even when an alternating axial force is applied to them for expansion of the bougie.

If the bougie is made of plastic, both rods 310 and 312 can be connected by adhesion or thermal fusion. A pre-sterilized plastic bougie can be made cheaply enough to be disposed after one use, thereby avoiding any need for additional sterilization.

In addition, the plastic bougie may be cured so that it is softer and more elastic in its front end (i.e., in the curved portion at the left in FIG. 18) than in the remaining part. As a result, the front or curved part functions as a leader which facilitates insertion of the bougie into the urinary bladder through the urethra.

FIGS. 18 to 23—Operation

In use, the sterilized and assembled bougie, which is in the state shown in FIG. 18, is inserted into the urethra. The bougie can be easily moved forward until protruding lobes 332 and 334 come into contact with the urethral stricture. The moment of contact of lobes 332 and 334 with the stricture can be distinctly felt by the urologist and this will be a signal that the expansion operation should be commenced.

To accomplish this, cylindrical head 370 is manually rotated so that its threads 372 mate to a greater extent with those on portion 366 of rod 310. Since surface 378 of head 370 is in contact with collar 376, rotation of head 370 will push central rod 326 forward so that its front wedging elements 332 and 334 and its rear wedging elements 340 and 342 move rods 310 and 312 apart, expanding the bougie and thus dilating the stricture of the urethra. The degree of expansion is determined by position of handle 344 with respect to scale 370*a* on the surface of head 370.

Since rod 312 is shorter than rod 310 and does not reach head 370, expansion of the bougie will not concentrate stress at the front end of the head. The use of two wedging elements provides uniform expansion of the bougie over its entire length.

It will be understood by those skilled in the art that more than two wedging elements can be used.

For withdrawal of the bougie from the urethra, the urologist reverses rotation of head 370 so that depression 388 contacts abutting surface 386 on the front side of split part 380. As a result, thrust developed by head 370 is transmitted to core rod 326 which moves back and allows rods 310 and 312 to return to their initial or contracted state. The bougie is then extracted.

If the bougie is made of metal, it is then disassembled and sterilized. For this purpose, head 370 is rotated so that threaded portion 316 of rod 310 is unscrewed from cylindrical head 370 while split part 380 is squeezed and pulled through hole 382 in the head.

After unscrewing head 370 from the probe, rod 312 is separated from rod 310 by turning rod 310 with respect to rod 312 on tooth 317 as a fulcrum point. Then tooth 317 of rod 310 is removed from opening 315 of rod 312.

During rotation, rod 312 is pulled through and snaps past ribs 356 and 358 and then through gap 360 formed by ears 352 and 354. Central rod 326 is removed by passing it through longitudinal slot 368 in the threaded part 366 of the rear end of rod 310. After sterilization, the bougie is assembled in reverse order. Since the rods can be disconnected, cleaning and sterilization procedures are improved and facilitated.

Other Applications Of Internal Vibratory Stimulation

A. Urinary And Anal Incontinence

To treat stress urinary incontinence, the bladder is anesthetized and filled with saline as above. The bougie of FIGS. 1–8 is inserted into the urethra. The vibrational frequency of the bougie for this method is initially between 10 and 20 Hz, then between 60 and 90 Hz for three minutes. The treatment is repeated two to three times a week for four weeks.

The oscillations of the mechanical bougie not only stimulate the muscle and surrounding tissue but actually train the urethral sphincters through the rapid expansion and contraction of the muscle. This action leads to normalization of the sphincteric muscle contractility through the reflexogenic effect of the stimulation. The vibratory stimulation according to this invention has further therapeutic effects on the neuromuscular structure of the urethra, urinary bladder, detrusor muscle and pelvic floor muscles.

Anal incontinence may be treated in the same way with an appropriately sized vibratory bougie according to this invention.

B. Urethral Syndrome

It is established that a majority of patients with urethral syndrome caused by chronic urethritis have a reduced urine flow rate. This is associated with the development of fibrosis and an increase in the rigidity of the urethral wall, which, in turn, lead to the formation of intraurethral obstruction. In view of the above, gradual dilation of the urethra to its physiological diameter caused by expansions which accompany the operation of our instrument, may provide, simultaneously with the vibratory massage, a therapeutic effect.

In patients with functional urethral spasms, endourethral vibratory stimulation with frequency within the limits of 30–40 Hz will cause relaxation of the striated urethral muscle. Thus, in conjunction with simultaneous cyclic contractions and expansions, vibratory massage may result in normalization of the function of the voluntary urethral sphincter.

For the treatment of the urethral syndrome secondary to hypoestrogenism, endourethral massage is part of a complex treatment, as these patients will at the same time receive conventional treatment in the form of estrogen therapy. In this group of the patients the vibratory massage of the urethra will improve functional and organic condition of the mucosa and submucosa.

C. Other Uses

The bougies can be used to provide vibrational and massaging actions for other diseased portions of the urethra and surrounding tissue, the ureter, the rectum, or any other body cavity. This is very desirable for reducing lesions, making it even possible to treat patients suffering from impotence and other related diseases. This was impossible with conventional bougies. Moreover, the chances of complications are greatly reduced since the bougie of the invention will have far less tendency to traumatize the urethra. In addition, the bougie can be used for dilation of nephrostomic fistulae.

Other Modifications Of The Vibratory Apparatus

The disclosed treatment method for internal muscle and connective tissue disorders may be practiced with a radially expandable and contractable probe actuated by any suitable means. For example, the apparatus of the preferred embodiments may be modified to incorporate a radially expandable and contractable probe actuated pneumatically or hydraulically. Thus, the scope of our invention is not limited to the preferred embodiments disclosed here.

We claim:

1. A method for treating urethral strictures comprising providing a vibration source;

inserting said vibration source into a urethra;

using said vibration source to apply vibratory stimulation to the wall of the urethra at a selected position;

selecting said position in the urethra by inserting said vibration source into the urethra to a point substantially at the stricture point;

wherein said vibratory stimulation includes alternating expansion and contraction of the vibration source at a single predetermined frequency to cause alternating expansion and contraction of the urethra to massage and stimulate adjacent tissue; and said predetermined frequency is between five and 60 Hz.

2. A method for treating urinary incontinence comprising providing a vibrating source;

inserting said vibration source into a urethra;

using said vibration source to apply vibratory stimulation to the walls of the urethra at a selected position;

wherein said vibratory stimulation includes alternating expansion and contraction of the vibration source at a single predetermined frequency to cause alternating expansion and contraction of the body cavity to massage and stimulate adjacent tissue; and said predetermined frequency is between 60 and 90 Hz.

3. A method for applying a radially outwardly directed force to the inside surface of a body cavity comprising the steps of providing an instrument having a probe with an expandable portion and a means for actuating said probe;

inserting said probe into the body cavity;

placing the expandable portion of said probe at the point at which the radially outwardly directed force will be applied;

actuating the means for actuating to alternately expand and contract said expandable probe portion for a predetermined time, thereby alternately applying the radially outwardly directed force at said point while holding another portion of the body cavity stationary and holding said point stationary while applying the radially outwardly directed force to said other portion of the body cavity; and removing said probe from the body cavity at the end of said predetermined time.

4. The method of claim 3 wherein said body cavity is a urethra.

5. The method of claim 3 wherein said body cavity is a ureter.

6. The method of claim 3 wherein said body cavity is a rectum.

7. The method of claim 3 including the step of expanding and contracting said expandable probe portion at a predetermined frequency.

8. The method of claim 7 in which said predetermined frequency is in the range of 5 to 60 Hertz.

9. The method of claim 7 in which said predetermined frequency is in the range of 10 to 30 Hertz.

10. A method for applying a radially outwardly directed force to the inside surface of a body cavity comprising the steps of providing an instrument having a probe with an expandable portion and means for actuating said probe;

inserting said probe into the body cavity;

placing the expandable portion of said probe at the point at which the radially outwardly directed force will be applied;

actuating the means for actuating to alternately expand and contract said expand probe portion for a predetermined time;

removing said probe from the body cavity at the end of said predetermined time, wherein said means for actuating has a plurality of reciprocating elements and a means for actuating said reciprocating elements, said probe having a plurality of flexible elements attached to said reciprocating elements equal in number to the number of reciprocating elements, said reciprocating elements each being capable of moving independently of the other reciprocating elements to flex and unflex the flexible element to which it is attached, thereby expanding and contracting said expandable portion of the probe.

11. The method of claim 10 wherein the number of reciprocating elements is two.

12. The method of claim 11 wherein the reciprocating elements have semicircular cross-sections.

13. A method for applying a radially outwardly directed force to the inside surface of a body cavity comprising the steps of providing an instrument having a probe with an expandable portion and means for actuating said probe;

inserting said probe into the body cavity;

placing the expandable portion of said probe at the point at which the radially outwardly directed force will be applied;

actuating the means for actuating to alternately expand and contract said expand probe portion for a predetermined time;

removing said probe from the body cavity at the end of said predetermined time, wherein said means for actuating has a plurality of reciprocating elements and a means for actuating said reciprocating elements, said probe having a plurality of flexible elements attached to said reciprocating elements equal in number to the number of reciprocating elements, said reciprocating elements each being capable of moving independently of the other reciprocating elements to flex and unflex the flexible element to which it is attached, thereby expanding and contracting said expandable portion of the probe, said method including the step of actuating each reciprocating element separately at a predetermined frequency such that each flexible element flexes separately at the same predetermined frequency.

14. The method of claim 13 in which said predetermined frequency is in the range of 5 to 60 Hertz.

15. The method of claim 13 in which said predetermined frequency is in the range of 10 to 30 Hertz.

16. A method for applying a radially outwardly directed force to the inside surface of a body cavity comprising the steps of providing an instrument having a probe with an expandable portion and means for actuating said probe;

inserting said probe into the body cavity;

placing the expandable portion of said probe at the point at which the radially outwardly directed force will be applied;

actuating the means for actuating to alternately expand and contract said expand probe portion for a predetermined time;

removing said probe from the body cavity at the end of said predetermined time, in which said probe has a plurality of flexible elements bound together at a first end of each element, and said means for actuating comprises a handle and a core in contact with said flexible elements, said core having means for expanding said flexible elements when said core is rotated, wherein said actuation step comprises alternately rotating said handle and core in a first direction and in a second direction to expand and contract said flexible elements.

17. The method of claim 16 wherein said body cavity is a urethra.

18. The method of claim 16 wherein said body cavity is a ureter.

19. The method of claim 16 wherein said body cavity is a rectum.

20. The method of claim 16 wherein the direction of rotation of said means for actuating is changed at a predetermined frequency.

21. The method of claim 20 in which said predetermined frequency is in the range of 5 to 60 Hertz.

22. The method of claim 20 in which said predetermined frequency is in the range of 10 to 30 Hertz.

23. The method of claim 16 wherein the number of reciprocating elements is two.

24. The method of claim 23 wherein the reciprocating elements have semicircular cross-sections.

25. A method for applying a radially outwardly directed force to the inside surface of a body cavity comprising the steps of providing an instrument having a probe with an expandable portion and means for actuating said probe;

inserting said probe into the body cavity;

placing the expandable portion of said probe at the point at which the radially outwardly directed force will be applied;

actuating the means for actuating to alternately expand and contract said expand probe portion for a predetermined time;

removing said probe from the body cavity at the end of said predetermined time, in which said probe comprises a plurality of flexible elements bound together at a first end of each element, one of said flexible elements having threads formed on its surface at a second end, and said means for actuating comprises a sleeve formed with threads that cooperate with the threads on the one flexible element, wherein said actuation step comprises alternately rotating said sleeve in a first direction and in a second direction to expand and contract said flexible elements.

26. The method of claim 25 wherein said body cavity is a urethra.

27. The method of claim 25 wherein said body cavity is a ureter.

28. The method of claim 25 wherein said body cavity is a rectum.

29. The method of claim 25 wherein the direction of rotation of said means for actuating is changed at a predetermined frequency.

30. The method of claim 29 in which said predetermined frequency is in the range of 5 to 60 Hertz.

31. The method of claim 29 in which said predetermined frequency is in the range of 10 to 30 Hertz.

32. The method of claim 25 in which the means for actuating said probe further comprises a core which cooperates with said sleeve and with said flexible elements to cause said flexible elements to expand, said core having lobe portions which cooperate with holes in said flexible elements.

33. The method of claim 32 in which said core further comprises means for extending said lobe portions through said holes beyond the outer periphery of said flexible elements.

34. The method of claim 33 in which said core further comprises means for retracting said lobe portions into said holes.

35. The method of claim 33 wherein said body cavity is a urethra.

36. The method of claim 33 wherein said body cavity is a ureter.

37. The method of claim 33 wherein said body cavity is a rectum.

38. The method of claim 35 further including the step of determining the point at which the radially outwardly directed force will be applied, said point being a point of stricture in the urethra, said point being determined by extending said lobe portions beyond the periphery of said flexible elements and inserting said probe into the urethra until said lobe portions meet a resistance at the point of stricture.

39. The method of claim 25 wherein said sleeve is rotated a predetermined amount in said first and second directions.

40. The method of claim 38 wherein said sleeve further comprises means for indicating the degree of the sleeve's rotation from a reference point.

41. A method for applying radially outwardly directed force to the inside surface of a body cavity comprising the steps of providing an instrument having a probe with a cam, an expandable portion and a means for actuating the probe;

inserting the probe into the body cavity;

placing the expandable portion of the probe at the point at which the radially outwardly directed force will be applied;

actuating the means for actuating to move the cam with respect to the expandable portion alternately in a first direction and in a second direction, thereby alternately expanding and contracting the expandable probe portion at a predetermined frequency; and removing the probe from the body cavity at the end of a predetermined time.

42. The method of claim 41 wherein the expandable portion comprises a plurality of flexible elements.

* * * * *